US006325147B1

(12) United States Patent
Doerler et al.

(10) Patent No.: US 6,325,147 B1
(45) Date of Patent: Dec. 4, 2001

(54) ENHANCED OIL RECOVERY PROCESS WITH COMBINED INJECTION OF AN AQUEOUS PHASE AND OF AT LEAST PARTIALLY WATER-MISCIBLE GAS

(75) Inventors: Nicole Doerler, rue des Pavillons; Gérard Renard, rue Henri Dunant; Alexandre Rojey, rue Alexandre Dumas, all of (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 0 days.

(21) Appl. No.: 09/550,204

(22) Filed: Apr. 17, 2000

(30) Foreign Application Priority Data

Apr. 23, 1999 (FR) ..... 99 05584

(51) Int. Cl.[7] ..... E21B 43/22; E21B 47/00

(52) U.S. Cl. ..... 166/252.1; 166/53; 166/90.1; 166/266; 166/268; 166/270.1

(58) Field of Search ..... 166/50, 53, 90.1, 166/252.1, 266, 268, 270.1, 401, 402, 403

(56) References Cited

U.S. PATENT DOCUMENTS

| | | | | |
|---|---|---|---|---|
| 2,875,831 | * | 3/1959 | Martin et al. | 166/266 |
| 2,875,833 | * | 3/1959 | Martin | 166/268 |
| 3,893,511 | | 7/1975 | Suzuki . | |
| 4,319,635 | | 3/1982 | McKay . | |
| 4,601,337 | * | 7/1986 | Lau et al. | 166/268 X |
| 4,653,583 | * | 3/1987 | Huang et al. | 166/252.1 |
| 4,676,313 | * | 6/1987 | Rinaldi | 166/252.1 |
| 4,683,948 | * | 8/1987 | Fleming | 166/268 X |
| 4,721,158 | * | 1/1988 | Merritt, Jr. et al. | 166/252.1 |
| 4,763,730 | | 8/1988 | Root . | |
| 4,953,618 | * | 9/1990 | Hamid et al. | 166/90.1 X |
| 5,056,596 | | 10/1991 | Jones . | |
| 5,375,976 | * | 12/1994 | Arnaudeau | 415/199.5 |
| 5,421,408 | * | 6/1995 | Stoisits et al. | 166/268 |
| 5,503,226 | * | 4/1996 | Wadleigh | 166/252.1 |
| 5,634,520 | * | 6/1997 | Stevens et al. | 166/402 |

FOREIGN PATENT DOCUMENTS 886035 12/1998 (EP) .

* cited by examiner

*Primary Examiner*—George Suchfield
(74) *Attorney, Agent, or Firm*—Antonelli, Terry, Stout & Kraus, LLP

(57) ABSTRACT

Process intended for enhanced recovery of a petroleum fluid by combined injection of an aqueous phase saturated with acid gases. The process esentially consists in continuously injecting, into the oil reservoir, a mixture of an aqueous phase and of a gas at least partially soluble in the aqueous phase and at least partially miscible with the petroleum fluid, by controlling the ratio of the flow rates of the aqueous phase and of the gas so that the latter is always in a state of saturation or oversaturation at the bottom of the injection well(s). The aqueous phase saturated or oversaturated with gas comes into contact with the petroleum fluid present in the reservoir. The gas dissolved in the aqueous phase is at least partially transferred to the liquid hydrocarbon phase, thus causing swelling and viscosity reduction of this phase, which favors migration of the petroleum fluid towards a production zone. Acid fractions of effluents coming from the subsoil or from chemical or thermal industries are preferably used as such gases. The process can be applied for an enhanced recovery of hydrocarbons in reservoirs.

21 Claims, 2 Drawing Sheets

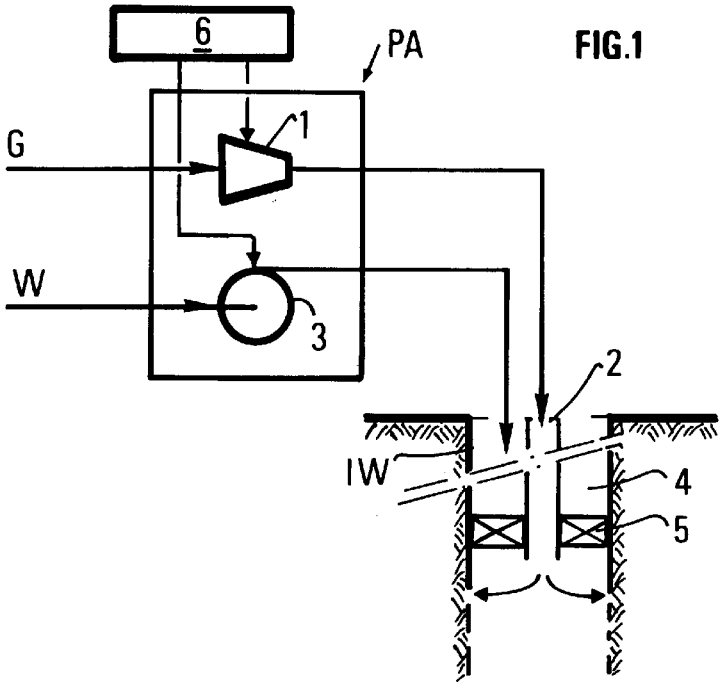
FIG.1
FIG.2
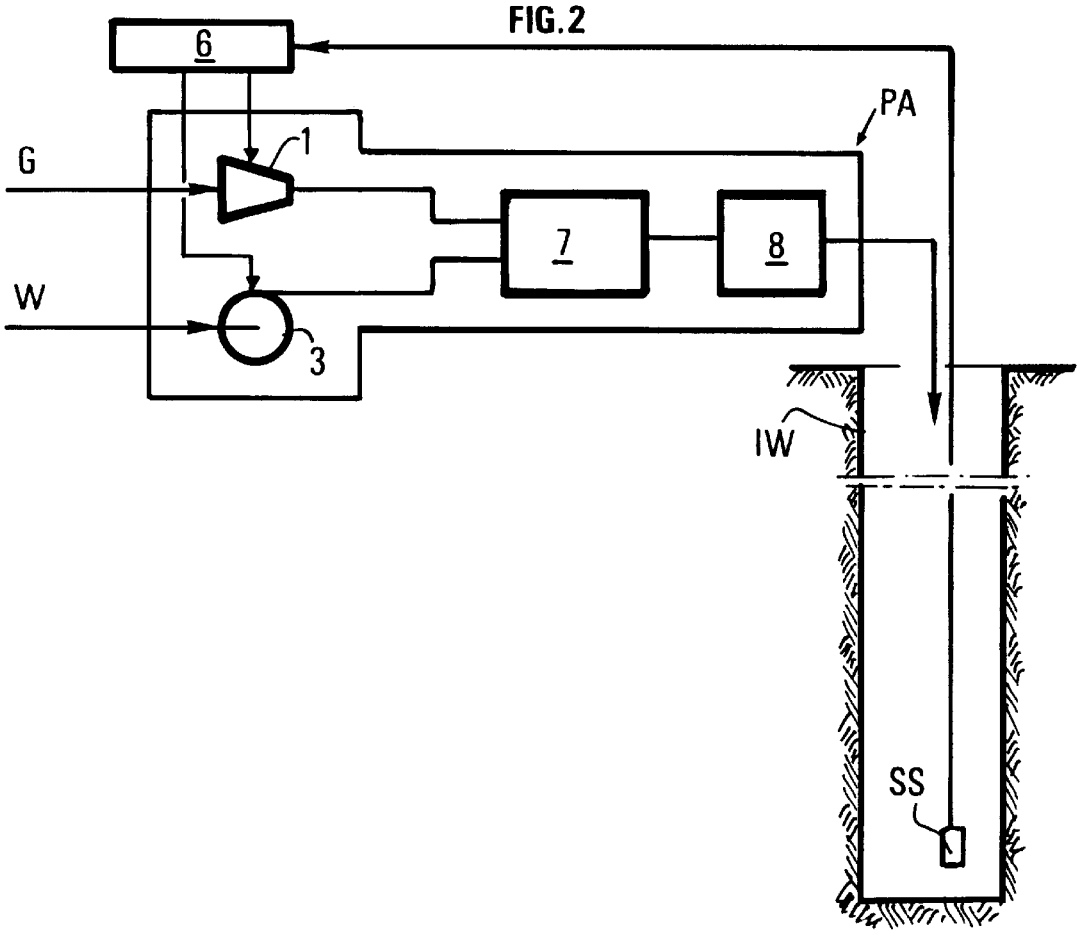

ENHANCED OIL RECOVERY PROCESS WITH COMBINED INJECTION OF AN AQUEOUS PHASE AND OF AT LEAST PARTIALLY WATER-MISCIBLE GAS

FIELD OF THE INVENTION

The present invention relates to an enhanced oil recovery process with combined injection of water and of gas in a reservoir.

The process according to the invention finds applications notably for improving the displacement of petroleum fluids towards producing wells and therefore for increasing the recovery ratio of the usable fluids, oil and gas, initially in place in the rock.

BACKGROUND OF THE INVENTION

There are many processes, referred to as primary, secondary or tertiary type processes, allowing to recover hydrocarbons in reservoirs.

The recovery is referred to as primary when the petroleum fluids are produced under the sole action of the energy present in-situ. This energy can result from the expansion of the fluids under pressure in the reservoir: expansion of the oil, saturated with gas or not, expansion of a gas cap above the oil reservoir, or an active water table. During this stage, if the pressure in the reservoir falls below the bubble point of the oil, the gas phase coming from the oil will contribute to increasing the recovery ratio. Natural drainage recovery scarcely exceeds 20% of the fluids initially in place for light oils and it is often below this value for heavy oil reservoirs.

Secondary recovery methods are used to prevent too great a pressure decrease in the reservoir. The principle of these methods consists in supplying the reservoir with an external energy. Fluids are therefore injected into the reservoir through one or more injection wells in order to displace the usable petroleum fluids (referred to as "oil" hereafter) towards production wells. Water is often used as the displacement fluid. Its efficiency is however limited. A large part of the oil remains in place notably because the viscosity thereof is often higher than that of water. Furthermore, the oil remains trapped in the pore contractions of the formation as a result of the great interfacial tension difference between the latter and the water. Finally, the rock mass is often heterogeneous. In this context, the water injected will flow through the most permeable zones to reach the producing wells without sweeping large oil zones. These phenomena induce a great recovery loss.

Pressurized gas can also be injected into a reservoir for secondary recovery, gas having the well-known property of displacing appreciable amounts of oil. However, if the formation is heterogeneous, the gas being much less viscous than the oil and the water in place, it will flow through the rock by following only some of the most permeable channels and will rapidly reach the producing wells without the expected displacement effect.

It is also well-known to combine water and gas injections according to a method referred to as WAG method (Water Alternate Gas). According to this method, water and gas are injected successively as long as the petroleum fluids are produced under economical conditions. The purpose of water slugs is to reduce the mobility of the gas and to widen the swept zone. Many improvements have been proposed for this technique: surfactants can be added to the water in order to decrease the water-oil interfacial tension, a foaming agent can be added to the water: the foam formed in the presence of the gas significantly reduces the mobility thereof. Such a method is for example described in U.S. Pat. No. 3,893,511. The applicant's patent FR-2,735,524 also describes an improved process consisting in adding an agent reducing the interfacial tension between the water and the gas to at least one of the water slugs alternately injected. Under the effect of this agent, alcohol for example, the oil cannot spread on the water film covering the rock mass. The oil remains in the form of droplets that slow the displacement of the gas down. The applicant's patent FR-2,764,632 describes a process comprising alternate injection of gas slugs and of water slugs wherein a pressurized gas soluble in both water and oil is added to at least one of the water slugs. The production stage comprises releasing the pressure prevailing in the reservoir so as to generate gas bubbles that drive the hydrocarbons out of the pores of the rock mass.

These secondary recovery techniques lead to recovery ratios of 25 to 50% of the oil initially in place.

The purpose of tertiary recovery is to improve this recovery ratio when the residual oil saturation is reached. This designation is applied to the injection, into a reservoir, of a miscible gas, of a microemulsion, of steam, or to in-situ combustion.

The definition of these primary, secondary and tertiary recovery techniques and their chronological application during production of a reservoir date from several years. Pressure maintenance techniques are currently used from the start of reservoir development and fluid injection techniques previously referred to as tertiary are carried out before a marked decline of the initial pressure of the reservoir.

More than 30% of the hydrocarbon fields produced contain acid compounds such as $CO_2$ and $H_2S$. Development of these fields requires treating processes allowing the usable gases to be separated from the acid gases. The carbon dioxide coming from these plants is often discharged into the atmosphere, thus increasing the climate disturbances and the greenhouse effect. Hydrogen sulfide management is problematic because of the high toxicity of this gas. It is generally converted to solid sulfur by means of a Claus chain. This process requires a high investment on which a return is not secured in times where the world production of solid sulfur exceeds the needs. Reinjection of these acid gases in the reservoir after complete or partial solubilization in an aqueous phase, which can be all or part of the production water, fresh water or a brine from a groundwater table, sea water or others, affords two advantages: it allows to get rid of the acid gases at a low cost, without any polluting atmospheric discharge, and to increase the reservoir productivity.

SUMMARY OF THE INVENTION

The process intended for enhanced recovery of a petroleum fluid produced by a reservoir according to the invention aims, through combined injection of an aqueous phase and of a gas from an external source or, as far as possible, at least partly of acid gases coming from effluents from the reservoir itself, to increase the hydrocarbon recovery ratio.

The process comprises continuous injection, through an injection well, of a sweep fluid consisting of an aqueous phase to which a gas at least partially miscible in the water and in the petroleum fluid has been added, with permanent control, at the head of the injection well, of the ratio of the flow rates of this aqueous phase and of the gas forming the sweep fluid so that the gas is in a state of saturation or of oversaturation at the bottom of the injection well.

The sweep fluid can be formed either at the well bottom with separate transfer of the constituents to the injection zone, or at the well head.

A means arranged in the injection well can be used to create a pressure drop, for example a valve or a pipe restriction, and thus to increase the dissolution ratio of the gas in the water. A packing placed in the injection well in order to intimately mix the gas and the aqueous phase of the sweep fluid also increases the pressure drop and the dissolution ratio.

According to an embodiment, a multiphase rotodynamic type pump is for example used to compress the gas, to pressurize the aqueous phase and to intimately mix this aqueous phase and the pressurized gas prior to injecting the mixture into the injection well.

To ensure that the gas is at least in a state of saturation (preferably of oversaturation at the well bottom), data produced by state detectors at the well bottom (permanently installed pressure detectors, temperature detectors, etc.) are preferably used to check that the gas of the sweep fluid is at least in a state of complete saturation.

The gas in the sweep fluid contains at least one acid gas such as carbon dioxide and/or hydrogen sulfide and possibly, in variable proportions, other gases: methane, nitrogen, etc. These gases can be taken from effluents coming from a reservoir, an operation carried out in a treating plant suited to separate them from other gases otherwise usable, or they can come from chemical or thermal plants burning lignite, coal, fuel oil, natural gas, etc.

The aqueous phase used to form the sweep fluid can for example be water coming from an underground reservoir (a groundwater table for example, or a brine produced during development of a reservoir), or any other water readily available (sea water).

According to another embodiment, a surfactant is added to the aqueous phase in order to favour dispersion of the gas and/or one or more surfactants can be added thereto in order to increase the solubility of the gas in the sweep fluid.

According to another embodiment, the sweep fluid is for example injected into one or more greatly deflected wells, horizontal wells or wells with a complex geometry located for example at the base of the reservoir and the petroleum fluid is produced for example through one or more deviated wells or wells of complex geometry that can be located at the top of the reservoir.

The process can be implemented from the start of the reservoir development. The aqueous phase preferably injected on the periphery of the producing zone sweeps the porous medium containing the hydrocarbons to be recovered. At the beginning of this circulation, the carbon dioxide, much more soluble in oil than in the water injected, goes from the sweep fluid to the petroleum fluid, causing swelling and decreasing the viscosity thereof. These two phenomena favour an increase in the recovery of the hydrocarbons in place. When the fluid gets closer to the production wells, its pressure falls under the combined effect of the pressure drops linked with the flow and of the natural depletion of the reservoir. If the pressure is lower than the bubble-point pressure of the water containing the solubilized gas, gas bubbles will form by nucleation in the pores of the rock mass and drive the oil contained therein towards the most permeable zones where it will be swept. Not only does this phenomenon increase the overall recovery ratio of the oil in place, but it also decreases the time required to reach a given recovery ratio.

The invention also relates to a system intended for enhanced recovery of a petroleum fluid extracted from a reservoir, by continuous injection into the reservoir of a sweep fluid consisting of an aqueous phase mixed with a gas at least partially miscible in the aqueous phase and in the petroleum fluid, which comprises a sweep fluid conditioning unit and a control unit allowing permanent control of the conditioning unit, suited to control the ratio of the flow rates of this aqueous phase and of the gas forming the sweep fluid that has reached the well bottom, so that the gas is in a state of saturation or oversaturation. The system preferably comprises state detectors placed in the injection zone to measure thermodynamic parameters and connected to the control unit.

BRIEF DESCRIPTION OF THE DRAWINGS

Other features and advantages of the process according to the invention will be clear from reading the description hereafter of non limitative examples, with reference to the accompanying drawings wherein:

FIG. 1 shows a first embodiment of the process where the sweep fluid is formed at the well bottom in the injection zone, FIG. 2 shows a second embodiment of the process where the sweep fluid is formed at the surface.

DETAILED DESCRIPTION OF THE INVENTION

Figure 3:
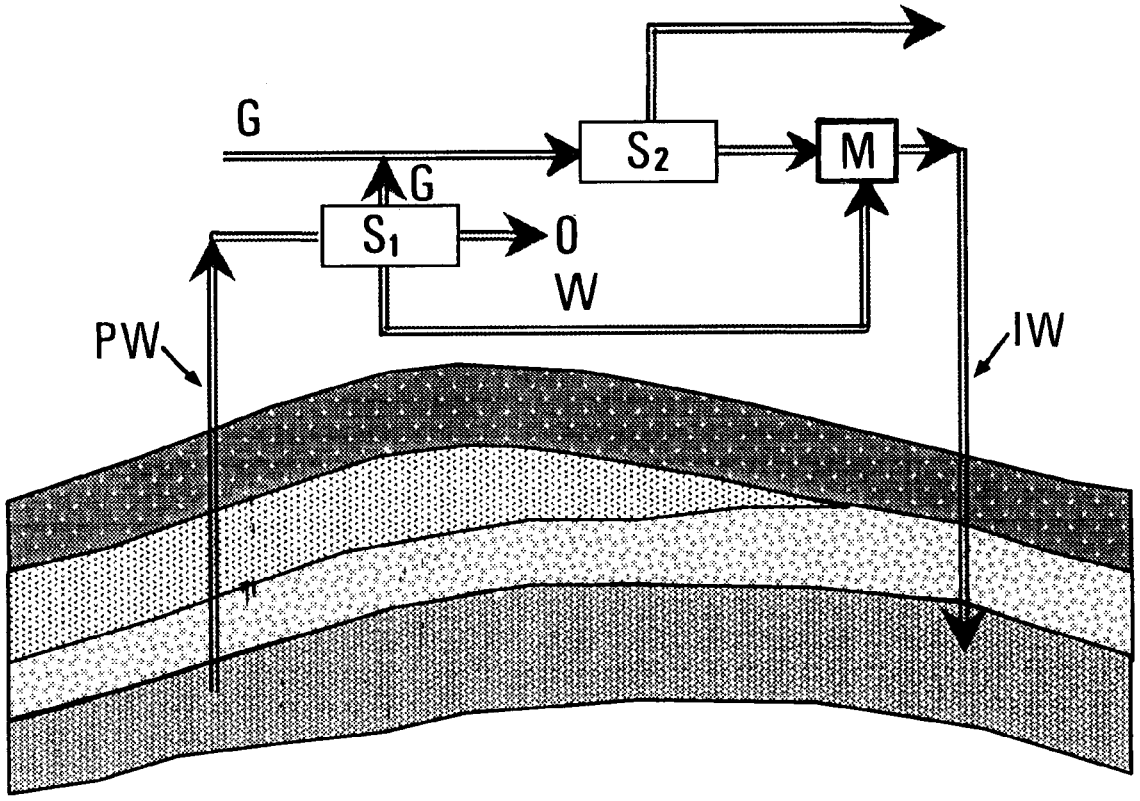
FIG. 3 shows an embodiment where the gas in the sweep fluid consists of acid fractions of gas coming from the subsoil or produced by process units or thermal plants burning various materials.

The recovery process which is the object of the present invention comprises four stages:

1. Preparation of the Sweep Fluid

Although this is not limitative, gases that are readily available and not used otherwise, such as carbon dioxide $CO_2$ or hydrogen sulfide $H_2S$, are preferably used.

The carbon dioxide mixed with the aqueous phase (referred to as water hereafter) reacts according to the balanced reaction:

$$CO_2+H_2O \leftrightarrows H_2CO_3$$

giving carbonic acid. The solubility of the carbon dioxide in the water depends on the salinity of the water, on the temperature and on the pressure. The dissolution ratio of $CO_2$ increases with the pressure and decreases with the temperature. In the pressure and temperature range found for injection applications, typically a pressure ranging from 75 to 300 bars (7.5 to 30 MPa) and a temperature ranging from 50 to 100° C., the effect of the pressure is preponderant. In other words, the dissolution ratio of carbon dioxide at the bottom of an injection well is higher than the dissolution ratio at the surface despite the temperature increase due to the geothermal gradient.

At pressures below 100 bars, $CO_2$ dissolves less in salt water than in pure water. At a higher pressure, the salinity affects the solubility of the gas much less. In pure water, under a pressure of 150 bars (15 MPa) and at a temperature of 70° C., the solubility of $CO_2$ is about 4.5% by weight (45 kg $CO_2$ are dissolved in 1 $m^3$ water). Dissolution of the acid gas in the water leads to a viscosity increase, which improves the water/oil mobility ratio. The dissolution ratio of hydrogen sulfide in water is higher, approximately by a factor of 2, than that of carbon dioxide, whatever the temperature, the pressure and the composition of the aqueous phase. By way of example, under a pressure of 150 bars and at a temperature of 70° C., the solubility of $H_2S$ is about 8.3% by weight (83 kg $H_2S$ are dissolved in 1 $m^3$ water). The acid gases coming from the petroleum production mainly contain carbon dioxide, it is the solubility of this gas that will be limitative when the mixture is dissolved in an aqueous fluid.

2. Injection of the Sweep Fluid

An important point which makes the process according to the invention particularly efficient for sweeping a reservoir is that the sweep fluid is so injected that at the well bottom, in the injection zone, the water solution injected is at least saturated and preferably oversaturated with gas.

The volumes of acid gases and of water that can be reinjected into the reservoir can be available in a ratio that is much higher than the solubility ratio of the acid gas in the water. This ratio can evolve during development or according to production constraints. The pressure increase at the bottom of the injection well is partially compensated by a temperature increase linked with the geothermal gradient. However, the effect of the pressure is generally greater, all the more so since the fluid injected does not reach the thermal equilibrium conditions while flowing.

For this saturation or oversaturation condition at the well bottom to be permanently met, an injection system that can be placed entirely at the surface or also comprise elements at the well bottom is used.

According to the embodiment shown in FIG. 1, the sweep fluid is produced by a conditioning unit PA and its constituents are separately transferred to the injection zone at the well bottom. The gas G is compressed by a compressor 1 and injected through an injection tube 2 to the bottom of injection well IW, while the water W coming from a pump 3 is injected into the annular space 4 between the casing and injection tube 2. Mixing of the two phases takes place below packer 5 above the injection zone. The injection pressures of compressor 1 and of pump 3 are determined by a control device 6.

According to a preferred embodiment, for gas injection requiring a high pressure at the well head, mixing is preferably performed at the surface before injection. This simultaneous injection permits an increase in the weight of the liquid column in the injection well and a significant reduction of the required gas pressure. In order to obtain the required saturation and preferably oversaturation condition at the well bottom, the mixture obtained at the well head must be highly oversaturated with acid gases and particularly homogeneous, the gas being dispersed in the liquid phase.

A conventional compression and pumping device (FIG. 2) known to specialists can therefore be used to inject the sweep fluid in a state of saturation or oversaturation in the well bottom. In this case, the acid gases are compressed in a compressor 1 in successive stages and cooled between two compression sections. In parallel, the water W is pressurized by a pump 3 to a pressure equal to that applied by compressor 1. The gas G and the liquid W are then fed into a static or dynamic mixer 7 having a sufficient efficiency to allow total dispersion of the gas in the liquid. Downstream from mixer 7, the mixture can be compressed by an additional pump 8 in order to allow either dissolution of an additional amount of gas, or injection of the sweep fluid into well IW. The acid gases, heated during compression, can for example be cooled by means of heat exchangers (not shown) prior to being fed into mixer 7 so as to favour their dissolution.

A rotodynamic type multiphase pump can advantageously replace a conventional reinjection chain and fulfil the following three functions: compress the gas, pressurize the liquid phase and intimately mix the two phases. A rotodynamic mutliphase pump suited for this type of application is described in patents FR-2,665,224 (U.S. Pat. No. 5,375,976) filed by the applicant or FR-2,771,024 filed by the applicant. By its design, this type of pump can inject into a well a two-phase mixture consisting of saturated carbonate water and of excess gaseous carbon dioxide without any cavitation problem.

It is also possible to introduce an additional pressure drop in the injection line in the form of a throttling valve or of a restriction of the injection line. According to a particular embodiment, a packing is also provided in injection well IW in order to improve mixing of the constituents while inducing an additional pressure drop. In either case, state detectors SS are preferably used, which are lowered onto the well bottom, in the injection zone, to measure various thermodynamic parameters: pressures, temperatures, etc., and are connected to control device 6. A transmission system suited to transmit to the surface signals coming from detectors permanently installed in wells for reservoir monitoring, notably state detectors permitting, for example, the temperatures and pressures prevailing at the well bottom to be known, is notably described in patent U.S. Pat. No. 5,363,094 filed by the applicant. Control device 6 adjusts the flow rates and their ratio in this case according to the conditions prevailing in situ.

According to the embodiment shown in FIG. 3, the system is suited to form a mixture, saturated or oversaturated at least partially by controlled recombination of effluents pumped from the reservoir through one or more production wells PW of the reservoir. These effluents generally contain a liquid phase consisting of water W and oil O, and a gas phase G. The effluents are thus passed through a water-oil-gas separator S1. The gas phase G, possibly completed by external supply, flows through a separator S2 intended to separate the gases recoverable for other applications from the acid gases to be recycled. The water W coming from separator S1 is then recombined with the acid gases recovered in a controlled mixing device M so as to form the saturated or oversaturated mixture under to conditions prevailing at the well bottom.

If the pressure required to inject the fluid into the rock mass is lower than the liquefaction pressure of $CO_2$, a liquid phase and a gas phase will be present in the injection well. The user must make sure that dispersion of the gas reaches a maximum level and that the gas slugs circulating in the injection well are carried along by the liquid column at the well bottom, in other words that the liquid velocity is higher than the upflow velocity of the gas slugs in order to prevent segregation in the injection well.

It is also possible that the pressure required to inject the fluid into the rock mass is higher than the liquefaction pressure of $CO_2$. The liquefied gas will be intimately mixed with the water and an emulsion consisting of fine droplets of liquefied gas in water will then be injected.

A small proportion of a surfactant favouring dispersion of the gas bubbles is preferably added to the aqueous phase. In order to reduce the excess gas in relation to the saturation conditions prevailing at the surface, the solubility of the carbon dioxide in the water can be increased by adding thereto additives favouring its dissolution, such as monoethanolamine, diethanolamine, ammonia, sodium carbonate, potassium carbonate, sodium or potassium hydroxide, potassium phosphates, diaminoisopropanol, methyldiethanolamine, triethanolamine and other weak bases. The concentration of these additives in the water can range from 10 to 30% by weight. It has been noticed that a solubility agent such as monoethanolamine added to the water in a proportion of 15% by weight increases for example by a factor of 7 the solubility of CO, in water. The injection wells can be vertical or horizontal wells. In general, if the reservoir is not very thick, it can be advantageous to inject carbonate water into greatly deflected or horizontal wells. The aqueous phase can be injected at the base of the reservoir to be drained by means of one or more horizontal wells and the liquid hydrocarbon phase can be recovered at the top of the reservoir by means of one or more horizontal wells. For thick reservoirs, the injection and production wells will be vertical, and sweeping of the hydrocarbons in place will be performed parallel to the limits of the reservoir. Wells with a more complex geometry can be used without departing from the scope of the present invention.

3. Reservoir Sweeping

The recovery principle according to the invention allows to supply the reservoir with additional energy. Simultaneous injection of water and acid gases affords many advantages.

The carbonate water solubilizes the soluble carbonates present in the rock, calcite and dolomite, by forming soluble bicarbonates according to the reactions:

$$Ca\ CO_3+H_2CO_3 \leftrightarrows Ca\ (HCO_3)_2$$

$$Mg\ CO_3+H_2CO_3 \leftrightarrows Mg\ (HCO_3)_2$$

This partial dissolution of the carbonates leads to a permeability increase of the porous medium, whether a sandstone, in which dissolution will attack the cements and the calcic deposits often present around quartz grains, or a limestone formation in which the porous connection will be improved. The permeability gain resulting from dissolution of the carbonates can be significant, as it is well-known to specialists.

It is also well-known that carbonate water prevents swelling of the clays often present in petroleum reservoirs. This effect is particularly noticeable for clays whose base ion is sodium. Calcium dissolution also has an effect on stabilization of clays with sodium ions by replacing the sodium by calcium, which gives more stable clays that withstand flow without crumbling and clogging the porous medium.

The viscosity of the water increases when the $CO_2$ dissolves therein. The volume of this carbonate water increases by 2 to 7% according to the concentration of the dissolved gas and its density slightly decreases. The global effect of the decrease of the density contrast between the water and the oil reduces gravity segregation risks. In parallel, the water/oil mobility ratio is improved through the oil/water viscosity ratio decrease. These facts contribute to significantly improving the efficiency with which the water sweeps the oil.

Carbon dioxide is much less soluble in water than in reservoir oils. This solubility depends on the pressure, the temperature and the characteristics of the oil. Under certain conditions, the carbon dioxide can be partially or totally miscible with the hydrocarbons. When it is injected into the reservoir in the form of carbonate water, the carbon dioxide will preferably go from the water to the oil.

Dissolution of the carbon dioxide in oil leads to a significant volume increase. With the same dissolution ratio of the carbon dioxide, this phenomenon will be more noticeable for light oils than for heavy oils.

Dissolution of the carbon dioxide in oil also leads to a decrease in its viscosity. This decrease is more significant when the amount of $CO_2$ increases. An oil with a high initial viscosity will be more sensitive to this phenomenon. By way of example, the viscosity of an oil having an API gravity of 12.2 (0.99 g/cm$^3$) and a viscosity of 900 mPa.s at ambient pressure and at a temperature of 65° C. will fall to 40 mPa.s under a pressure of 150 bars of $CO_2$. Under similar conditions, the viscosity of an oil with an API gravity of 20 (0.93 g/cm$^3$) will fall from 6 to 0.5 mPa.s.

Swelling and viscosity decrease of the oil favour an increase in the recovery of the hydrocarbons initially in place in the reservoir. They also allow to accelerate the hydrocarbon recovery process.

The carbonate water is at least saturated with $CO_2$ when it is injected into the reservoir. In the porous medium, the pressure of the fluid injected will fall because of the pressure drops linked with the flow. When the pressure is lower than the bubble-point pressure of the water containing the solubilized gas, gas will be released. Nucleation of the carbon dioxide bubbles will preferably take place in contact with the rock and specifically in zones with a high rock/liquid interface concentration. These zones correspond to low-permeability rocks; swelling and migration of the gas bubbles will expel the oil trapped in the small-diameter pores of the rock. This phenomenon significantly increases the proportion of the hydrocarbons displaced during production.

The recovery process as described above finds an advantageous application when production of a reservoir with a double porosity system, such as fractured reservoirs, is started. A simple representation of such reservoirs is a set of rock blocks of decimetric or metric size having small-diameter pores and saturated with oil, connected together by a network of fractures providing a passage for the flow of fluids of several ten micrometers on average.

Two types of fractured reservoirs can be typically distinguished: reservoirs whose rock is water wet, and reservoirs of average wettability or oil wet reservoirs (for example certain carbonate rock massifs).

When these reservoirs are subjected to water injection within the scope of improved recovery of petroleum effluents, the water will preferably invade the fractures. The water will then tend to imbibe the low-permeability blocks by driving the oil trapped in the pores towards the fracture network. If the reservoir is water wet, imbibition will take place under the effect of the capillary forces and of gravity. If the reservoir is oil wet, only gravity will favour the imbibition phenomenon.

When carbonate water is injected into the fractured medium, in the case of a water wet reservoir, displacement of the oil by imbibition in low-porosity blocks is followed by expansion of the carbon dioxide when the pressure is lower than the bubble-point pressure of the carbonate water. The development of gas bubbles trapped in the low-permeability rocks induces a highly increased oil recovery.

In the case of a reservoir of average water wettability or of an oil wet reservoir, the phenomenon of imbibition by water will be less efficient, the capillary forces do not favour displacement of the oil by water. The carbon dioxide released during depletion advantageously replaces the water and invades the matrix blocks.

Development of the reservoir can comprise injection and depletion cycles. During the injection period, production is stopped or decreased whereas carbonate water injection is maintained in order to raise the pressure in the reservoir above the bubble-point pressure of the water and thereby to increase the concentration of the carbon dioxide available. This injection period is followed by a period of production and of partial depletion of the reservoir.

4. Production

In the course of time, the hydrocarbons produced have increasing acid gas concentrations. As mentioned above, these gases are advantageously separated from the otherwise usable gas and reinjected into the reservoir. If the gas processing and refining plants are close to the producing wells, the gas and the oil are separated by successive expansions in separating drums S1, S2 (FIG. 3) located near to the production zone. If the heavy crude refining plant is too far away from the production zone, the crude containing the gas can be transported under pressure. $CO_2$, which noticeably decreases the viscosity of heavy oil, advantageously replaces a fluxing agent.

Comparative tests have been carried out in the laboratory on oil-impregnated cores selected and suited to represent a fractured reservoir. They were placed in a containment cell associated with a pressurized fluid circulation system of the same type, for example, as those described in patents FR-2,708,742 (U.S. Pat. No. 5,679,885) or FR-2,731,073 (U.S. Pat. No. 5,679,885) filed by the applicant, and subjected to various tests wherein they were swept by a gas phase under the aforementioned gas saturation or oversaturation conditions. These tests have allowed to show the efficiency of the process according to the invention.

For the same temperature, it has been observed that an increasing concentration of $CO_2$ in the carbonate water induces a great increase in the recovery of the oil in place. This increase is very marked when the sweep fluid is oversaturated with gas.

What is claimed is:

1. A process for enhanced recovery of a petroleum fluid produced by a reservoir, comprising continuously injecting a sweep fluid into the reservoir, through an injection well (IW), the sweep fluid comprising water mixed with gas at least partially miscible in the water and in the petroleum fluid, and permanently controlling, at the injection well head, the ratio of the flow rates of the water and of the gas forming the sweep fluid so that the gas is in a state of saturation or of oversaturation therein at the bottom of the injection well.

2. A process as claimed in claim 1, comprising forming the sweep fluid by mixing the gas with the water at the well bottom.

3. A process as claimed in claim 1, comprising forming the sweep fluid by mixing the gas with the water at the well head.

4. A process as claimed in claim 1, comprising placing a control means in the well to increase the dissolution ratio of the gas in the water.

5. A process as claimed in claim 1, comprising intimately mixing the gas and the water of the sweep fluid using a packing placed in the injection well.

6. A process as claimed in claim 1, intimately mixing the water and the gas, and injecting the mixture into the injection well using a multiphase pump.

7. A process as claimed in claim 1, comprising using data provided by state detectors at the well bottom for checking that the gas of the sweep fluid is at least in a state of saturation.

8. A process as claimed in claim 1, wherein the gas in the sweep fluid comprises at least one acid gas.

9. A process as claimed in claim 1, further comprising extracting at least part of the gas in the sweep fluid from the effluents produced by the reservoir.

10. A process as claimed in claim 1, further comprising forming at least part of the gas in the sweep fluid using gaseous effluents coming from chemical or thermal plants.

11. A process as claimed in claim 1, further comprising producing all or part of the water for the sweep fluid from an underground reservoir.

12. A process as claimed in claim 1, comprising adding a surfactant to the water of the sweep fluid to increase the solubility of the gas in the sweep fluid.

13. A process as claimed in claim 1, comprising adding at least one additive to the water of the sweep fluid to increase the solubility of the gas in the sweep fluid.

14. A process as claimed in claim 1, injecting the sweep fluid in greatly deflected wells, horizontal wells or wells of complex geometry.

15. A process as claimed in claim 14, comprising injecting the sweep fluid in at least one greatly deflected well, horizontal well or well of complex geometry located at the base of the reservoir.

16. A process as claimed in claim 1, comprising recovering the petroleum fluid through at least one deviated well or well of complex geometry.

17. A process as claimed in claim 16, comprising recovering the petroleum fluid through a deviated well or well of complex geometry is located at the top of the reservoir.

18. A system intended for enhanced recovery of a petroleum fluid extracted from a reservoir, by continuous injection into the reservoir of a sweep fluid comprising an aqueous phase mixed with a gas at least partially miscible in this aqueous phase and in the petroleum fluid, comprising a sweep fluid conditioning unit and a control unit allowing permanent control of the conditioning unit, suited to control the ratio of the flow rates of the aqueous phase and of the gas forming the sweep fluid at the well bottom, so that the gas is in a state of saturation or oversaturation therein.

19. An enhanced recovery system as claimed in claim 18, characterized in that it comprises state detectors in the injection zone, intended to measure thermodynamic parameters and connected to control unit.

20. A process as claimed in claim 3, comprising placing a control means in the well to increase the dissolution ratio of the gas in the aqueous phase.

21. A process as claimed in claim 8, wherein the at least one acid gas is selected from the group consisting of carbon dioxide and hydrogen sulfide.

* * * * *